US005393380A

United States Patent [19]

Reed et al.

[11] Patent Number: 5,393,380

[45] Date of Patent: Feb. 28, 1995

[54] POLYDIALLYL DIMETHYL AMMONIUM CHLORIDE/3-ACRYLAMIDO-3-METHYL-BUTANOIC ACID COPOLYMERS AND THEIR USE FOR PITCH CONTROL IN PAPER MILL SYSTEMS

[75] Inventors: Peter E. Reed, Naperville; Carol S. Greer, Lisle, both of Ill.

[73] Assignee: Nalco Chemical Company, Naperville, Ill.

[21] Appl. No.: 184,520

[22] Filed: Jan. 18, 1994

Related U.S. Application Data

[63] Continuation of Ser. No. 970,427, Nov. 2, 1992, abandoned.

[51] Int. Cl.[6] ..... D21H 17/44

[52] U.S. Cl. ..... 162/168.2; 162/199; 162/DIG. 4

[58] Field of Search ..... 162/168.3, 168.2, 199, 162/DIG. 4

[56] References Cited

U.S. PATENT DOCUMENTS

| | | | |
|---|---|---|---|
| 2,471,959 | 5/1949 | Hunt | 526/219 |
| 3,414,547 | 12/1968 | Thompson . | |
| 4,610,801 | 9/1986 | Matthews et al. | 252/181 |
| 4,715,962 | 12/1987 | Bhattacharyya | 210/708 |
| 5,131,982 | 7/1992 | St. John | 162/168.2 |

FOREIGN PATENT DOCUMENTS 1150914 2/1983 Canada .

*Primary Examiner*—Christopher Henderson
*Attorney, Agent, or Firm*—Robert A. Miller; Joseph B. Barrett; James J. Drake

[57] ABSTRACT

Diallyl dimethyl ammonium chloride/3-acrylamido-3-methyl-butanoic acid copolymers were prepared and found to be effective pitch control agents in papermaking systems.

3 Claims, 2 Drawing Sheets

POLYDIALLYL DIMETHYL AMMONIUM CHLORIDE/3-ACRYLAMIDO-3-METHYL-BUTANOIC ACID COPOLYMERS AND THEIR USE FOR PITCH CONTROL IN PAPER MILL SYSTEMS

CROSS-REFERENCE TO RELATED APPLICATION

This application is a continuation of application Ser. No. 07/970,427, filed Nov. 2, 1992, now abandoned.

GENERAL FIELD OF THE INVENTION

The invention relates to the use of certain diallyl dimethyl ammonium chloride copolymers for use in controlling pitch in paper mill systems.

INTRODUCTION

The problem of pitch control in papermaking has previously been recognized. The pitch in the fibers of wood pulps is associated with naturally occurring lignin dispersing agents. Cooking and mechanical agitation which occur during the pulping by the sulfite process liberate pitch and these natural dispersing agents. But, as a result of the mechanical work on the fibers, the natural dispersing agents liberated along with the pitch are inadequate to keep the pitch from depositing on the equipment employed in beating, hydrating, refining, bleaching, and even on the wire used for forming the sheet. Because of the tendency of the pitch to agglomerate within the pulp suspension or deposit on the surfaces of the wire or other equipment, the pitch frequently causes the formation of spots or holes in the sheet formed or may adhere to the wire or press rolls or drier rolls and cause tearing of the sheet. This results in the production of sheets with numerous imperfections. Among other consequences involved are the expense of cleaning the machinery frequently either with solvents or steam, and the loss of production during cleaning and during replacing operations caused by breakdown of the sheet.

Typical of the cationic polymers that are used commercially in the paper mills as pitch control agents are polydiallyl dimethyl ammonium chloride polymers and copolymers. Another group of polymers that have shown themselves to be effective in control are the polymers formed by..the polymerization of epichlorohydrin and dimethylamine. Typical of the use of this later group of polymers in pitch control is shown in the disclosure of Canadian patent 1,150,914.

The present invention is predicated upon the discovery that certain diallyl dimethyl ammonium chloride, (DADMAC) copolymers give superior colloidal pitch particle reduction in aqueous pulps.

THE DRAWINGS

THE INVENTION

Figure 1:
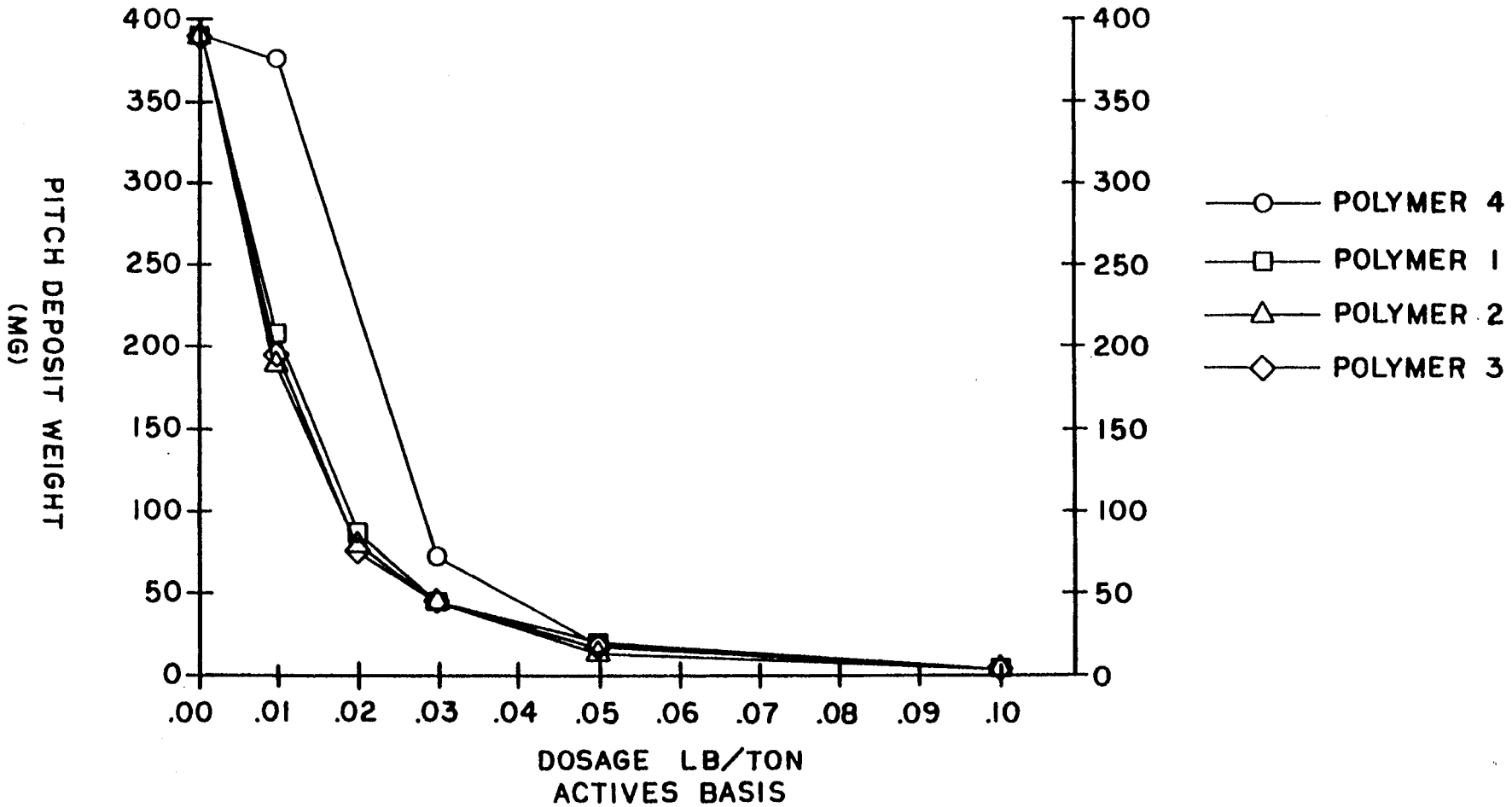
FIG. 1 is a drawing showing the compositions of the invention, their ability to control pitch with respect to comparing pitch deposit weight versus product dosage.

The invention comprises a process for controlling pitch deposition in pulp and papermaking systems which comprises adding to the pulp an effective amount of polydiallyl dimethyl ammonium chloride copolymer which contains from between 1–30 mole percent of 3-acrylamido-3-methylbutanoic acid (AMBA), and has an intrinsic viscosity of at least 0.5.

In a preferred embodiment of the invention the copolymers that give the best results contain between 1–30 mole percent of 3-acrylamido-3-methylbutanoic acid and more preferably 5–20 mole percent of 3-acrylamido-3-methylbutanoic acid. The preferred polymers when used as pitch control agents have intrinsic viscosities between 1–5, with typical commercial intrinsic viscosities being within the range of 1–2.5.

THE DADMAC-AMBA COPOLYMERS

In a broad aspect of the invention these copolymers contain from 1–30 mole percent of 3-acrylamido-3-methylbutanoic acid (AMBA). When used as pitch control agents, they preferably contain between 5–30 mole percent and most preferably 5–20 mole percent. It is expected that the AMBA comonomer imparts hydrophobic and ampholytic properties to the polymer that enhances the effectiveness of the polymer as a pitch control agent.

The polydiallyl dimethyl ammonium chloride 3-acrylamido-3-methylbutanoic acid copolymers of the invention should have an intrinsic viscosity of at least 0.5 dl/g to be effective for most commercial applications. A general range is 1–5. Most often an effective intrinsic viscosity within the range of 1 to 2.5.

While the copolymers of the invention are described and claimed with respect to the free acid form of 3-acrylamido-3-methylbutanoic acid, it is understood that they are most commonly either prepared or in the process which they are applied are converted to their alkali metal salt form. Typically the butanoic acid form of the 3-acrylamido-3-methylbutanoic acid will be in the sodium salt form, or at least a portion of the butanoic acid will be converted to the sodium salt form. Ammonium and amine salts may be useful in some applications.

The polydiallyl dimethyl ammonium chloride 3-acrylamido-3-methylbutanoic acid polymers are most conveniently prepared by a solution polymerization technique utilizing free radical catalysts, which is described more fully hereafter. When the preferred solution polymerization techniques are employed, they result in the preparation of polymer solutions having an active polymer content ranging from between about 5–30%. Generally the concentration will be 10–20%. These concentrations are convenient for purposes of transporting the polymer. They would be diluted at the point of use.

While solution polymerization using free radical catalysts is a preferred method of preparing the polymers, it is understood that they may also be prepared in the form of water-in-oil emulsions using a so called inverse emulsion polymerization technique. The method of polymerizing polydiallyl dimethyl ammonium chloride by inverse emulsion polymerization is described in detail in U.S. Pat. No. 4,715,962. With respect to this polymerization technique the disclosure of this patent is incorporated in reference.

METHOD OF PREPARING THE DADMAC-AMBA COPOLYMERS

As indicated, the preferred method of preparing the polydiallyl dimethyl ammonium chloride 3-acrylamido-3-methylbutanoic acid copolymers is by solution polymerization in the presence of a free radical catalyst. In order to achieve the higher intrinsic viscosities, it has been found that the polymerization should be conducted in the presence of about 1–30% or more by weight of an inorganic salt based on monomer. This polymerization scheme is described in U.S. application, Ser. No. 07/871,300, Filed Apr. 20, 1992, now U.S. Pat. No. 5,248,744 Entitled "Process of Polymerizing Diallyldialkyl Ammonium Compounds to Produce Higher Molecular Weight Polymers". The disclosure of this application is hereinafter incorporated by reference. Also, when amounts exceeding about 5 mole percent of 3-acrylamido-3-methylbutanoic acid are copolymerized with diallyl dimethyl ammonium chloride it is beneficial that the 3-acrylamido-3-methylbutanoic acid be slowly added to the diallyl dimethyl ammonium chloride solution over a period of time since the reactivity ratio between the two monomers is not equal. To prepare preferred polymers having high intrinsic viscosities, it is beneficial to use a water soluble azo catalyst, particularly the commercial material sold by E. I. dupont under the tradename, Vazo-50. This material is a water soluble azo catalyst. For a more complete description of azo catalysts as a source of free radicals for solution polymerizations, as well as other types of polymerization reference may be had to disclosure of U.S. Pat. No. 3,414,547 and U.S. Pat. No. 2,471,959. The disclosures of which are incorporated herein by reference.

To insure that the polymerization is optimized and that there is a minimum of residual monomer, a post addition of the free radical catalyst such as the Azo-50, is a desirable preferred step in the polymerization process. A preparative technique used in preparing the polydiallyl dimethyl ammonium chloride 3-acrylamido-3-methylbutanoic acid copolymers is set forth hereafter as Examples 1–4.

GENERAL SYNTHETIC PROCEDURE

1. The polymerization mixture is prepared by adding a solution of diallyl dimethyl ammonium chloride, sodium chloride, deionized water, the tretrasodium salt of ethylenediamine tetraacetic acid (EDTA) and a portion of the 3-acrylamido-3-methylbutanoic acid into a reaction vessel equipped with a stirrer, nitrogen inlet, condensor, heater and thermometer.

2. The polymerization mixture is then heated, purged with nitrogen, and maintained at a specific temperature falling within the range between 40°–90° C.

3. A free radical initiator solution is then slowly added over a 16 hour period. During this period, an aqueous solution of the remaining 3-acrylamido-3-methylbutanoic acid comonomer is added to the polymerization mixture. Optionally, up to 35% (based on monomer salts) deionized water may also be added during this period.

4. After a period of time sufficient to allow conversion of the diallyl dimethyl ammonium chloride monomer to exceed 80%, the final initiator solution is added and the temperature is raised (if necessary) to between 80°–90° C. for a period of time sufficient to raise the conversion to greater than 90%.

5. The reaction mixture is then diluted with an amount of deionized water sufficient to bring the polymer concentration to between 10–40 wt. %.

| Solution of a 5 Mole % AMBA Copolymer | |
|---|---|
| 67% DADMAC Monomer Solution | 250 gm |

-continued

| Solution of a 5 Mole % AMBA Copolymer | |
|---|---|
| Sodium Chloride | 30.5 gm |
| Deionized Water | 18.5 gm |
| EDTA | 0.05 gm |
| AMBA | 5.0 gm |
| 3.6% VAZO-50 Solution | 51.9 gm |
| 3.3% AMBA Solution | 155 gm |
| 2.3% VAZO-50 Solution | 81.9 gm |
| Deionized Water | 591 gm |

| Solution of a 14 Mole % AMBA Copolymer | |
|---|---|
| 67% DADMAC Monomer Solution | 250 gm |
| Sodium Chloride | 30.5 gm |
| Deionized Water | 18.5 gm |
| EDTA | 0.05 gm |
| AMBA | 14.0 gm |
| 3.6 VAZO-50* Solution | 51.9 gm |
| 10.7% AMBA Solution | 140 gm |
| 1.5% VAZO-50 Solution | 127 gm |
| Deionized Water | 678 gm |

*Azo catalyst

THE DOSAGE

The Dosage and Utilization of the Compositions of the Invention

The compositions of the present invention can be added to the pulp at any stage of the papermaking system. The compositions usually can be added as an aqueous solution. The effective amount of these compositions to be added depends on a number of variables, including the Ph of the system, hardness, temperature, and the pitch content of the pulp. Generally between 0.01–1 pound per ton of the composition on a polymer basis is added based on the weight of the pulp slurry. Good results are often achieved at a dosage of between 0.05–5 pound per ton (polymer basis).

The compositions of the instant invention are effective in controlling pitch deposition in papermaking systems, such as Kraft, acid sulfite, and mechanical pulp and papermaking systems. For example, pitch deposition in the brown stock washer, screen room and decker systems in Kraft papermaking processes can be controlled. The term "papermaking" is meant to include all pulp processes. Generally, it is thought that the polymers can be utilized to prevent pitch deposition on all wetted surfaces from the pulp mill to the reel of the paper machine under a variety of pHs and conditions. More specifically, these polymers effectively decrease the deposition of metal soap and other resinous pitch components not only on the metal surfaces, but also on plastic and synthetic surfaces such as machine wires, felts, foils, uhle boxes and headbox components.

EVALUATION OF THE INVENTION

Pitch Deposition Test Procedure

It was found that pitch could be made to deposit from a 1.4% consistency hardwood kraft fiber slurry containing approximately 1,650 ppm of a laboratory pitch and approximately 300 ppm calcium hardness (as $CaCO_3$) by adjusting the slurry to the desired test Ph (4.5, 6.0 or 7.5), adding the appropriate amount of inhibitor chemical and mixing the fiber slurry in an Osterizer blender for 4 minutes. The deposit was determined by the difference between the starting weight of a Teflon coupon suspended into the slurry during the test, and the dried weight of the coupon plus deposited pitch after completion of the test. The laboratory pitch was comprised of a mixture of primarily resin acids, fatty acids, and fatty esters.

Listed below is Table 1 which shows the diallyl dimethyl ammonium chloride 3-acrylamido-3-methylbutanoic acid copolymers which were evaluated. A part of the evaluation was to compare them against a commercial polydiallyl dimethyl ammonium chloride polymer which is used to control pitch.

TABLE 1

| DADMAC/AMBA Polymer No. | POLYMERS EVALUATED Mole % of AMBA |
|---|---|
| 1 | 14% (Example 2) |
| 2 | 7% |
| 3 | 5% (Example 1) |
| 4 | Commercial PolyDADMAC |

Figure 2:
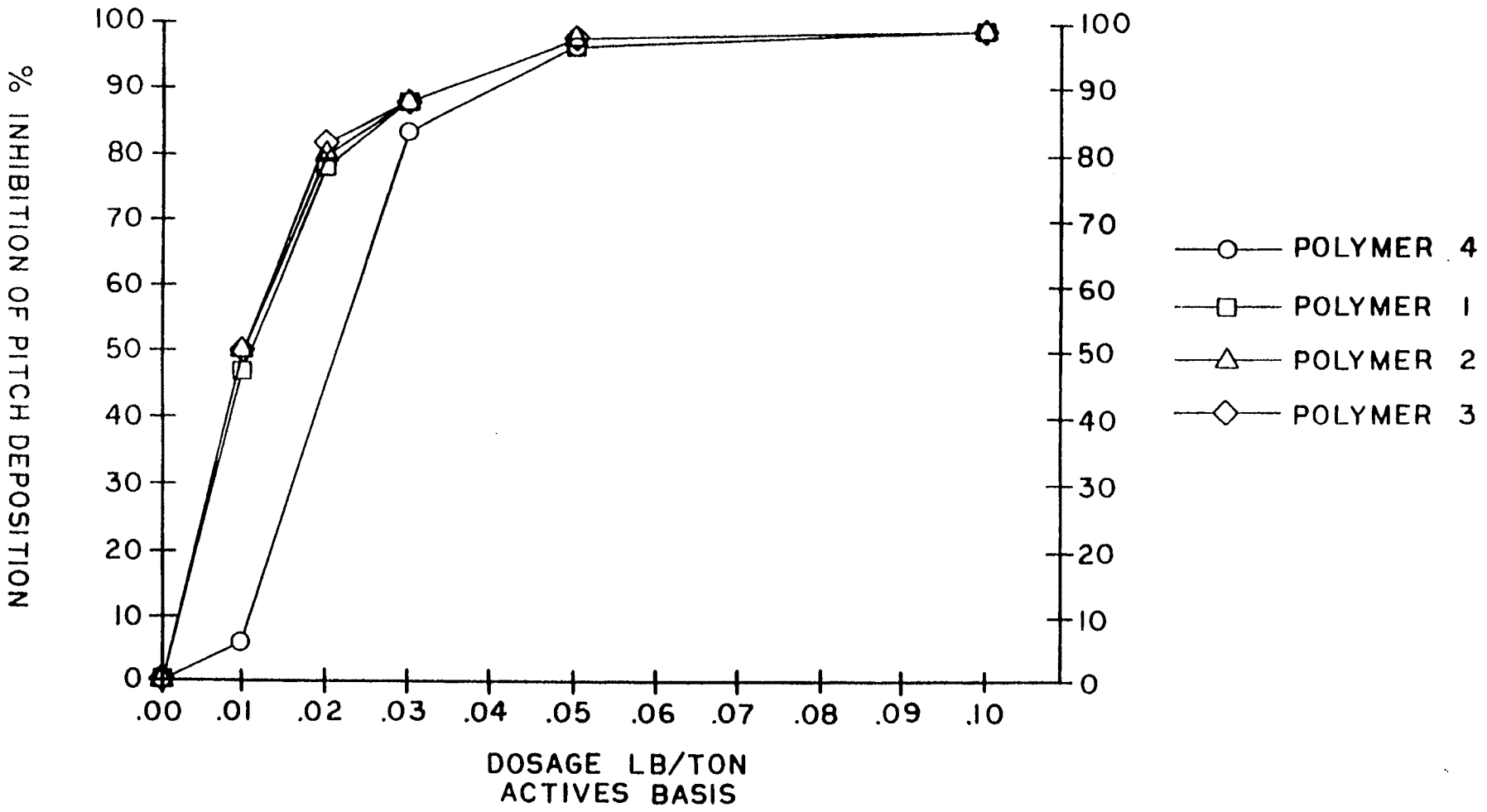
FIG. 2 shows the percent inhibition of pitch deposition when the paper mill system is treated with the compositions of the invention.

The compositions set forth in Table 1 were tested using the test procedure described above. The results of these tests are shown in FIGS. 1 and 2. These graphs demonstrate the superiority of the DADMAC-AMBA copolymers over polyDADMAC.

Having thus described our invention, it is claimed as follows:

1. A process for controlling the deposition of pitch contained within the fibers of wood pulp in pulp and paper making systems which pitch is the predominant form of pitch in the paper making system which comprises adding to the pulp an effective amount of polydiallyl dimethyl ammonium chloride copolymer which contains from between 1–30 mole percent of 3-acrylamido-3-methylbutanoic acid and has an Intrinsic Viscosity of at least 0.5 dl/g.

2. The process of claim 1 where the copolymer contains between 5–30 mole percent of 3-acrylamido-3-methylbutanoic acid and has an Intrinsic Viscosity within the range of between 1–5.

3. The process of claim 1 where the copolymer contains between 5–20 mole percent of 3-acrylamido-3-methylbutanoic acid and has an Intrinsic Viscosity within the range of between 1.2–5.

* * * * *